United States Patent [19]

Jones

[11] 4,058,070

[45] Nov. 15, 1977

[54] SEE-THROUGH SEWING GAUGE

[76] Inventor: Edna Jones, 20211 Charleston Ave., Detroit, Mich. 48203

[21] Appl. No.: 720,881

[22] Filed: Sept. 7, 1976

[51] Int. Cl.[2] ..... D05B 35/10

[52] U.S. Cl. ..... 112/153; 112/258

[58] Field of Search ..... 112/218 R, 260, 258, 112/217.1, 153, 136; 312/22, 23, 29

[56] References Cited

U.S. PATENT DOCUMENTS

| | | | |
|---|---|---|---|
| 312,196 | 2/1885 | Freeman | 112/260 X |
| 488,187 | 12/1892 | Curtis | 112/260 X |
| 820,523 | 5/1906 | Sandler | 112/153 |
| 2,708,892 | 5/1955 | Ayres | 112/260 X |
| 2,808,797 | 10/1957 | Ayres | 112/260 |
| 3,071,091 | 1/1963 | Erbland | 112/260 |

*Primary Examiner*—George H. Krizmanich
*Attorney, Agent, or Firm*—Harness, Dickey & Pierce

[57] ABSTRACT

There is disclosed herein an improved see-through sewing gauge comprising a gauge means for controlling the depth of a stitch during a sewing operation and having a window portion disposed therein adapted to cooperate with an opening provided in an associated throat plate so as to enable an operator to continuously monitor the condition of the bobbin thread supply disposed below said gauge. The gauge and window combination is movably secured to the throat plate of the sewing machine in such a manner as to be easily adjustable thereby enabling an operator to conveniently set the gauge to any desired depth of stitch.

10 Claims, 6 Drawing Figures

SEE-THROUGH SEWING GAUGE

BACKGROUND AND SUMMARY OF THE INVENTION

This invention relates generally to sewing machine gauges and, more particularly, to a gauge having provisions incorporated therein to enable an individual to continuously monitor the condition of the thread contained on a bobbin disposed below the gauge.

In conventional sewing machines, two supplies of thread must necessarily be provided. One of these is the thread supplying the needle itself which is usually in the form of a spool located on the upper portion of the machine and in plain view of the operator, thus allowing the operator to continuously monitor the amount of thread remaining, as well as the condition of the thread as it passes through various tensioning and other feed control devices. Thus, should this thread become snagged upon a portion of the machine or should the supply become exhausted, the operator will be immediately aware of the problem which may then be easily corrected.

The second supply of thread required on such machines is generally located in a bobbin case disposed in the lower portion of the machine, normally immediately adjacent to and below the needle. In normal operation, this bobbin case is concealed from view by a cover member or throat plate. Thus, the operator of the machine must either guess as to the condition and amount of thread remaining on the bobbin or go through the time consuming process of periodically removing the throat plate thereby exposing the bobbin for a visual inspection. This arrangement is particularly undesirable on machines being used for commercial operations, as it will likely result in bobbins being replaced before the thread supply is exhausted thus wasting materials in addition to reducing the output available from the machine and operator thereof as the operator must periodically cease production to inspect the condition of the bobbin thread supply. Should the operator continue sewing after the thread supply from the bobbin has been exhausted or otherwise interrupted, the stitches will not hold and thus it will be necessary to spend additional time removing the unsecured stitches and restitching the entire article thus consuming substantial time, reducing the machine and operator's output and otherwise delaying production. Additionally, when sewing certain types of materials, it will be impossible to go back and restitch the material should the bobbin thread become broken or the supply be exhausted during a stitching operation, as the initial needle punctures will remain visible thus incurring additional costs in the form of wasted material.

While such problems may be annoying to the homemaker doing only occasional sewing, they are extremely significant in high volume production work. It is estimated that a single production line seamstress will completely exhaust 50 bobbins during an 8 hour shift. That means that a single operator will be using approximately 6 bobbins an hour. When this figure is multiplied by numerous operators, it is apparent that substantial amounts of time, money, and materials may be wasted due to the inability to continuously monitor the bobbin thread supply and condition.

Various attempts have been made to provide a solution to this problem by providing assorted arrangements of apertures, lights, mirrors, and other devices designed to inform the operator of the bobbin thread condition. However, none of these arrangements have been totally acceptable.

In one arrangement, transparent plexiglass throat plates were designed to replace the typical metal plates. This arrangement worked quite well initially, but as material was continuously moved across the throat plate, the plexiglass became scratched and clouded thereby requiring frequent machine down time in order to replace them and rendering their usefulness over an extended time period uneconomical. Also when a stitch depth gauge was installed on the machine, it concealed the view of the bobbin. As such stitch depth gauges are commonly used in producting sewing, this device proved totally unsuitable for such applications.

Another arrangement provides a remotely located opening in combination with mirrors to enable the operator to view the bobbin. While this arrangement eliminates the problems associated with the transparent throat plate, it is expensive to install and requires the mirrors be readjusted for different operators thus making them costly to use on a production line basis. Additionally, the mirrors require cleaning periodically and are subject to breakage.

Accordingly, the present invention offers a unique solution to this problem in providing means by which the machine operator may easily continuously visually inspect the condition of the bobbin thread, the supply remaining on the bobbin, as well as observing the operation of bobbin stitching mechanisms. The present invention provides a stitching gauge which is specially adapted to include a window portion therein which cooperates with an opening provided in the throat plate to afford the operator an unobstructed view of the bobbin thread and associated feed mechanism. The device thus provided may be easily adapted to fit most any conventional home or industrial sewing machine and is extremely durable while still affording means for easily adjusting the stitch gauge for any particular job. As the material being sewn does not pass across the window, the device is extremely rugged and may be inexpensively fabricated the problems associated with these prior arrangements are effectively overcome. Further, the window may be adapted to be easily and quickly cleaned and/or replaced should it become damaged or broken thus minimizing machine down time while affording substantial savings in material costs and increasing operator productivity.

Additional features and advantages of the present invention will become apparent from the subsequent description and the appended claims taken in conjunction with the accompanying drawings.

DESCRIPTION OF THE PREFERRED EMBODIMENT

Figure 1:
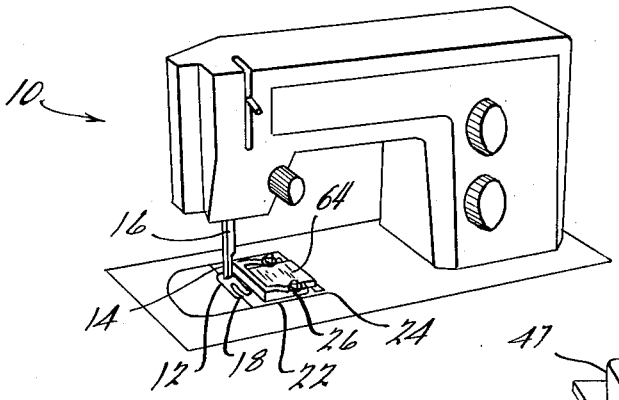
FIG. 1 is a perspective view of the invention shown in operative relationship to a portion of a sewing machine.

Referring now to FIG. 1, there is shown a conventional sewing machine indicated generally at 10 and including a presser foot 12, needle 14 and needle bar 16 adapted to reciprocate the needle into and out of an aperture provided in plate 18 located directly therebelow. Base plate 18 is provided with additional apertures adapted to accommodate feed dogs which project upward above the surface of the base plate and reciprocate so as to advance the material as the needle provides the stitching action thereto. Immediately adjacent and below these feed dogs and housed within the base portion 20 of the machine is a bobbin case and associated feed mechanism. The bobbin case has associated therewith a bobbin carrying a supply of thread and associated thread feeding mechanism. Access to this case is afforded through a generally rectangular opening 22 in the base plate 18 which is covered by a base or throat plate 24 during operation thereof. As these portions of the machine are well-known within the art, further description thereof is believed unnecessary.

In FIG. 1, base or throat plate 24 is modified in accordance with the present invention having a stitch gauge 26 with a transparent window 64 provided therein secured thereto all of which will be described in greater detail below.

Figure 2:
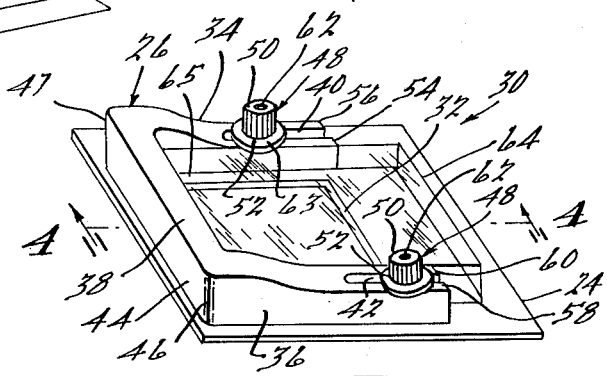
FIG. 2 is a perspective view of the see-through sewing gauge of the present invention.
Figure 3:
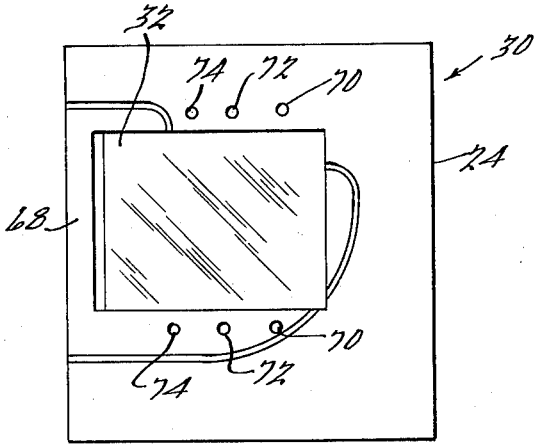
FIG. 3 is a bottom view of the throat plate in accordance with the present invention.
Figure 4:
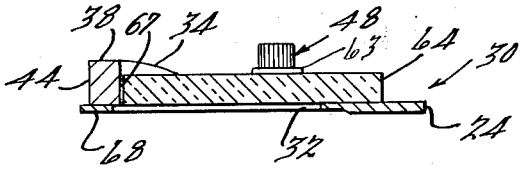
FIG. 4 is a sectional view of the present invention taken along line 4—4 of FIG. 2.

Referring now to FIGS. 2 through 4, there is shown a see-through sewing gauge in accordance with the present invention indicated generally at 30. The gauge 30 includes a base plate 24 having a generally rectangular shape adapted to fit within opening 22 of sewing machine 10 and is provided an aperture 32. Base plate 24 will generally be fabricated of metal and of a thickness so as to insure the top surface thereof will fit flush with base plate 18 of sewing machine 10. Aperture 32 will be of a generous size and positioned within base plate 24 so as to afford a clear unobstructed view of the bobbin thread supply and associated feed mechanism.

A gauge member 26 is adjustably secured to base plate 24 and is comprised of a pair of substantially parallel legs 34 and 36 extending outward from opposite ends of a cross member 38 so as to form a generally "U" shaped structure. Each of legs 34 and 36 has a longitudinally elongated slot 40 and 42 respectively extending therethrough adapted to allow gauge member 26 to be adjustably secured to base plate 24 as described below. Cross member 38 will generally be of a slightly greater thickness than legs 34 and 36 so as to insure a generous vertical wall 44 against which the material will travel. The outer wall portions 46 and 47 at the intersection of respective leg members 34 and 36 with cross member 38 are rounded so as to insure against the possibility of the material becoming snagged and to otherwise insure the smooth advancement of the material.

Threaded screw fasteners 48 are disposed in respective slots 40 and 42 each threadingly engaging apertures provided in base plate 24 and have an enlarged diameter cylindrically shaped top portion 50 provided with serrations around the circumference thereof which are adapted to allow finger tightening and loosening thereof. Top portion 50 forms a shoulder 52 which engages surfaces 54 and 56 of leg 34 and surfaces 58 and 60 of leg 36 so as to clamp legs 34 and 36 to base plate 24 once vertical wall portion 44 has been properly positioned with respect to the needle of the sewing machine so as to provide a guide to insure a constant distance between the edge of the material being sewn and the line of stitching. Also screw fasteners 48 are each provided with a hexagonal indentation 62 at the top of enlarged diameter portion 50 suitable for insertion of an allen wrench should additional tightening torque be desired. Additionally, should it be desirable, each of these screw fasteners 48 may be provided with a washer 63 so as to insure complete engagement with and secure clamping of respective portions 54, 56, 58 and 60 of leg members 34 and 36.

A transparent window member 64 is disposed between the leg members 34 and 36 and the cross member 38. This window is of a size to fit snuggly therebetween so as to be frictionally retained in position. As illustrated in FIG. 2, aperture 32 provided in base plate 64 has a width slightly less than the distance between leg members 34 and 36 thereby providing a shoulder portion 65 adjacent each of leg members 34 and 36 for supporting window member 64. Also window member 64 will be longer than aperture 32 so as to allow it to be supported at least one and possibly two additional sides thereof depending upon the position at which gauge member 26 is secured. In any event it is apparent that the three sided support in addition to the frictional fit with leg members 34 and 36 will positively prevent window member from dropping down into the bobbin case. If desired this window member may be of a slightly greater thickness than the leg portions 34 and 36 so as to allow the upper surface thereof to be engaged by washers 63 provided on screw fasteners 48 thereby clamping window member 64 to base plate 24 or should it be desirable, shoulder portion 52 may be sized to slightly overlap window member 64 so as to eliminate the need for washers 63 while still allowing window member 64 to be clamped in position. This arrangement thus insures that the window member 64 will be securely held in place during use of the device but yet still affords easy removal and replacement should window member 64 become scratched, broken or otherwise damaged. Alternatively, window member 64 may be secured in position by a suitable adhesive such as indicated at 67 of FIG. 4 should this be found desirable. While plexiglass is particularly well suited for this application, any other transparent material may be easily substituted therefore such as, for example, a polycarbonate composition or even glass.

Referring now to FIGS. 3 and 4, base plate 24 has a reduced thickness portion 68 shaped generally as shown on the bottom thereof which is provided to insure adequate clearance for the bobbin and associated feed mechanism. Also, three pairs of spaced apart threaded apertures 70, 72 and 74 are provided in the base plate for receiving the threaded portion of the screw fasteners 48 previously described. While a single pair of such apertures 72 would be sufficient, greater flexibility in adjustment of the gauge member is provided by the additional apertures 70 and 74 which allow the position of screw fasteners 48 to be selectively positioned for any particular job. These additional threaded apertures in combination with slots 40 and 42 afford a wide degree of movement of gauge member 26 with respect to base plate 24.

In order to utilize the above described see-through gauge, the operator need merely remove the existing bobbin cover plate from the machine and place the present invention in its place. Next, the operator will adjust the gauge to be desired stitch depth as measured between surface 44 and needle, secure the screw fasteners and then proceed in a normal fashion. The material to be sewn will be placed in the machine in a conventional manner with the edges adjacent the portion to be seamed abutting vertical wall 44 of gauge 26 thereby providing means by which the operator can insure a constant distance between the edge of the material and the seam. Also as will be noted, the main portion of the material will extend away from the gauge thereby leaving the window member 64 unobstructed and allowing the operator to easily view the condition of the bobbin thread. Should the supply of thread on the bobbin become exhausted, the operator will be immediately aware of this fact and be able to replace the bobbin.

Figure 6:
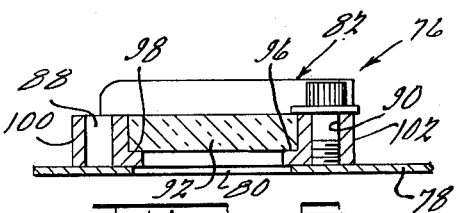
FIG. 6 is a view of the embodiment of FIG. 5 shown in section taken along line 6—6 of FIG. 5.
Figure 5:
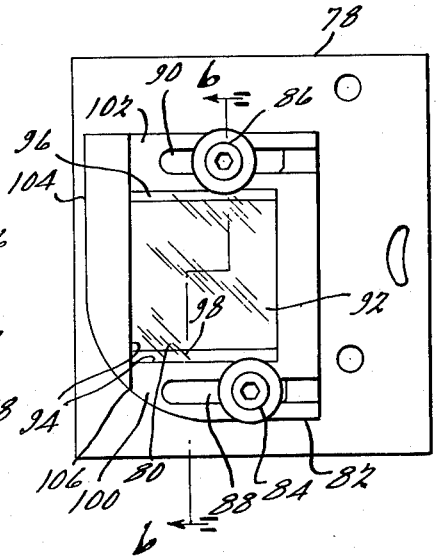
FIG. 5 is a top view of another embodiment of the present invention.

Referring now to FIGS. 5 and 6 another embodiment of the present invention is illustrated therein being generally indicated at 76. See-through sewing gauge 76 is similar to gauge 26 having a base plate 78 with an aperture 80 disposed therein, a gauge member 82 movably mounted thereon through the agency of screws 84 and 86 passing through elongated slots 88 and 90 respectively and a transparent window member 92 secured to gauge member 82. In this embodiment gauge member 82 is generally rectangular in shape and has an aperture 94 provided therein into which transparent window member 92 is secured. Gauge member 82 is provided with a pair of shoulder portions 96 and 98 projecting into aperture 94 from opposite side walls thereof which are adapted to provide support for window member 92. Shoulder portions 96 and 98 will generally be of a thickness approximately one half the total thickness of side portions 100 and 102. This support arrangement not only enables the gauge to be fabricated with a substantially reduced thickness window member but in that window 92 is spaced away from base plate 78 it will not become scratched by dust or dirt as it is moved during the adjustment of gauge member 82. Also, greater latitude in the size of aperture 80 in base plate 78 is afforded as only gauge member 82 is supported on base plate 78. As aperture 92 is enclosed on four sides by portions of the gauge member 82, window member 92 is prevented from any possibility of vibrating or otherwise slipping out of the gauge member. Further, the edges of the gauge member serve to afford the window member with increased protection. Window member 92 may be secured within aperture 94 in the same manner as described with reference to the embodiment of FIG. 2. Also similar to that of the embodiment of FIG. 2, gauge member 82 is provided with a substantially thicker wall surface portion 104 along which the edge of the material to be sewn is passed and an arcuate outer edge 106 at the junction of surface 104 with side portion 100 so as to insure smooth snag-free advancement of the material.

It is therefore apparent that the present invention provides a sewing gauge which may be manufactured very inexpensively and can easily be adapted to fit most any sewing machine so as to enable an operator thereof to substantially increase their productivity in that the device eliminates the time consuming need to periodically check the bobbin thread supply as well as reducing the amount of thread wasted in early bobbin replacement. Further, as the present invention allows continual visual monitoring this feed mechanism the operator will be immediately aware of any mechanical failure or other malfunctioning of this portion of the machine thereby enabling repairs to be made before additional damage is caused as well as preventing the production of faulty seams.

While it is apparent that the preferred embodiments of the invention disclosed provide a substantially improved sewing machine gauge, it will be appreciated that the invention is susceptible to modification, variation and change without departing from the proper scope of fair meaning of the subjoined claims.

We claim:

1. A see-through sewing machine gauge adapted to enable an operator to accurately control the distance between the edge of material being sewn and the line of stitching and simultaneously monitor the condition of a bobbin thread supply, said gauge comprising:

a throat plate having an opening provided therein, said opening being positioned so as to afford a view of said bobbin thread supply when said throat plate is in an operative relationship to said sewing machine;

a gauge member surrounding at least a portion of said opening;

means adjustably securing said gauge member to said throat plate; and a transparent member retained by said gauge member and overlying said opening so as to prevent objects from interferring with said bobbin thread supply and enable visual monitoring of said bobbin thread supply.

2. A see-through sewing machine gauge as set forth in claim 1 wherein said gauge member is generally "U" shaped having a pair of substantially parallel elongated leg members, said transparent member being secured between said leg members.

3. A see-through sewing machine gauge as set forth in claim 2 wherein said leg members are spaced apart a distance greater than the width of said opening.

4. A see-through sewing machine gauge as set forth in claim 3 wherein said leg members each have an elongated longitudinally extending slot provided therein, said means adjustably securing said gauge to said throat plate comprising a screw fastener passing through each of said slots and engaging a threaded aperture provided in said throat plate.

5. A see-through sewing machine gauge as set forth in claim 4 wherein said screw fasteners are each provided with a washer, said washer overlying a portion of said transparent member so as to clamp said transparent member to said throat plate.

6. A see-through sewing machine gauge as set forth in claim 2 wherein said transparent member is plexiglass and is secured between said leg members by an adhesive composition.

7. A see-through sewing machine gauge as set forth in claim 1 wherein said gauge member is rectangular in shape and has an opening provided therein, said opening being of a size larger than said opening in said throat plate, said transparent member being secured within said gauge member opening and cooperating with said throat plate opening to enable visual monitoring of said bobbin thread supply.

8. A see-through sewing machine gauge as set forth in claim 7 wherein said gauge member opening has a shoulder portion provided therein supporting said transparent member in a slightly spaced apart relationship to said throat plate.

9. A see-through sewing gauge as set forth in claim 8 wherein said means securing said gauge member to said throat plate comprise a pair of elongated slots provided on opposite sides of said opening in said gauge member, screw fasteners extending through said slots and engaging threaded apertures provided in said throat plate so as to releasably clamp said gauge member to said throat plate.

10. A see-through machine gauge as set forth in claim 9 wherein said screw fasteners are further adapted to clamp said transparent member against said shoulder portion.

* * * * *